US005421900A

United States Patent [19]

Clontz

[11] Patent Number: 5,421,900

[45] Date of Patent: Jun. 6, 1995

[54] SELF CONTAINED, BATTERY OPERATED SPRAY UNIT AND METHOD FOR USING THE SAME FOR CLEANING AIR CONDITIONING COILS

[76] Inventor: William H. Clontz, 5610 Eagle Way, Merrit Island, Fla. 32953

[21] Appl. No.: 155,192

[22] Filed: Nov. 22, 1993

[51] Int. Cl.[6] ..... B08B 3/00

[52] U.S. Cl. ..... 134/14; 239/305

[58] Field of Search ..... 239/302–309, 239/172, 530, 126, 1, 10; 134/34, 57 R

[56] References Cited

U.S. PATENT DOCUMENTS

| | | | |
|---|---|---|---|
| 1,834,781 | 12/1931 | Inman et al. | 134/14 X |
| 2,980,339 | 4/1961 | Bok et al. | 239/304 X |
| 3,140,050 | 7/1964 | Elmore | 239/304 X |
| 3,369,755 | 2/1968 | Roden et al. | 239/126 |
| 3,380,658 | 4/1968 | Stasz et al. | 239/130 |
| 3,454,030 | 7/1969 | Nelson | 137/112 |
| 3,456,848 | 7/1969 | Shaffer et al. | 239/172 X |
| 3,491,948 | 1/1970 | Alexander | 239/304 X |
| 3,504,858 | 4/1970 | Liddiard | 239/172 X |
| 3,615,818 | 10/1971 | Ruthner | 134/14 X |
| 3,651,830 | 3/1972 | Kollmai | 134/57 R |
| 3,680,786 | 8/1972 | Levy | 239/146 |
| 3,797,744 | 3/1974 | Smith | 239/172 |
| 4,089,470 | 5/1978 | Strahman | 239/304 |
| 4,111,715 | 9/1978 | Sprengling et al. | 134/26 X |
| 4,821,958 | 4/1989 | Shaffer | 239/131 |
| 4,822,647 | 4/1989 | Nozacki et al. | 239/126 X |
| 4,865,255 | 9/1989 | Luvisotto | 239/302 X |
| 4,878,598 | 11/1989 | Ruschhhaupt | 239/177 X |

*Primary Examiner*—Andres Kasnikow
*Assistant Examiner*—Kevin P. Weldon
*Attorney, Agent, or Firm*—Steven C. Stewart; James H. Beusse

[57] ABSTRACT

A self contained battery operated spray unit is provided for cleaning air-conditioning coils and other devices to be cleaned. The spray unit includes a solution tank and a rinse tank which are selected to be sprayed with a three way valve. Fluid from one of the tanks is pumped with a battery operated DC pump into a surge tank and out a spray wand when activated. The surge tank acts as a reservoir of pressure so that the pump does not have to continually cycle when in use, thereby increasing battery life. The pressure out of the wand is set to clean the conditioning coils without damaging them through excess pressure.

5 Claims, 2 Drawing Sheets

SELF CONTAINED, BATTERY OPERATED SPRAY UNIT AND METHOD FOR USING THE SAME FOR CLEANING AIR CONDITIONING COILS

BACKGROUND OF THE INVENTION

This invention relates to a transportable cleaning apparatus for use in heavy duty cleaning applications requiring the selective application of detergents or water alone and more particularly, to self-contained battery operated cleaning devices that spray cleaning fluid or water onto equipment to be cleaned.

Many portable cleaning devices are available for spraying detergents and water alone onto devices to be cleaned, and in particular, air-conditioning coils. These cleaning devices typically include an pump powered by an unlimited power source such as an AC power source, diesel engine, or pneumatic line, that is activated by a trigger to pump fluid out of a container, through a spray nozzle and onto the air-conditioning coil. A valve is used to select whether to pump fluid from either a detergent tank or from a water alone tank.

A drawback to the AC powered cleaning devices is that they require an electric power cord to connect an AC power source to power the pump. These cords are bulky and limit the distance the cleaning device can travel away from the AC power source.

Truly portable cleaning devices are powered by batteries. Most portable devices have a limited battery life. In many prior portable cleaning devices, to maintain proper pressure to the spray nozzle, the pump must be activated and remain activated instantly where triggered. This continuous and instant activation draws a large amount of current thereby quickly draining the battery.

Other problems associated with prior cleaning devices is that they apply a substantial amount of fluid pressure to the devices they are cleaning. This fluid pressure, when applied to air-conditioning coils, may dent the coils causing damage. Further, if insufficient pressure is not applied to the coils, the coils may not become cleaned.

SUMMARY OF THE INVENTION

An object of this invention is to provide an apparatus and method for cleaning air-conditioning coils.

Another object of this invention is to clean appliances with a battery operated portable cleaning device that has an extended battery life.

A further object of this invention is to apply cleaning solution to an air coil without damaging the coil through excessive pressure while maintaining sufficient pressure to the coil to remove dirt, dust or other unwanted particles.

It is an additional object of this invention to clean appliances with a battery operated portable device that pumps cleaning fluid or water alone from fluid containers while providing continuous recycling of the pump to reduce current drain from the battery.

These and other objects are provided with a self contained spray unit having a first fluid tank for holding fluid to be sprayed and a spray wand for dispersing fluid from the tank to devices to be sprayed. A surge tank is provided that is in fluid communication with the wand for maintaining a reservoir of pressure. A pump is also provided and has an inlet is connected to the fluid tank and an outlet connected to both the surge tank and the spray wand. The pump applies and continuously maintains the pressure applied to the wand and the surge tank at a predetermined level to prevent the pump from continuously recycling.

DESCRIPTION OF THE PREFERRED EMBODIMENTS

Figure 1:
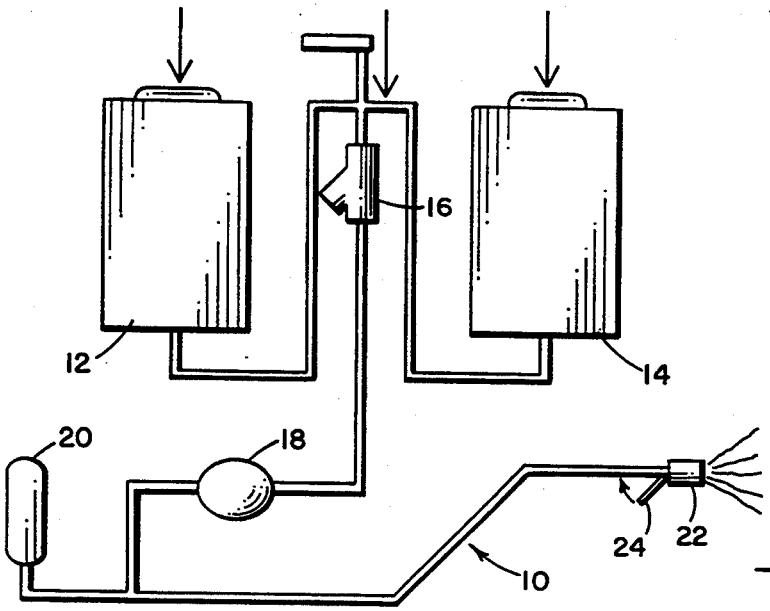
FIG. 1 is a simplified block diagram of fluid flow through the spray unit in accordance with the invention.

Referring to FIG. 1, there is shown as fluid flow diagram of spray unit 10. The spray unit 10 includes two fluid tanks, namely a solution tank 12 and a rinse tank 14 connected through a selectable three way valve 16 to the input of DC pump 18. DC pump 18 has an output which is connected to both surge tank 20 and spray wand 22.

During operation, three way valve 16 selects either solution tank 12 or rinse tank 14 from which liquid is to be pumped. DC pump 18 contains a sensor (not shown) which detects the pressure at its output. This pressure sensor enables pump 18 when the pressure at the output of the pump decreases below a predetermined level. Pressure sensors disable pump 18 when the output pressure of pump 18 reaches the predetermined level. When enabled, DC pump 18 urges liquid from the selected solution tank 12 or rinse tank 14 to its output and maintains a pressure at a predetermined level at its output. Surge tank 20 maintains a reservoir of pressure and liquid so that DC pump 18 does not have to continuously recycle. Spray wand 22 includes a trigger 24 which when activated open a valve to permit fluid in surge tank 20 to flow out spray wand 22 and onto the appliance to be sprayed. Preferably, surge tank 20 has a volume of about 22 cubic inches. Pump 18 continuously maintains the pressure being applied to the wand 22 and the surge tank 20 at a predetermined level.

Figure 2:
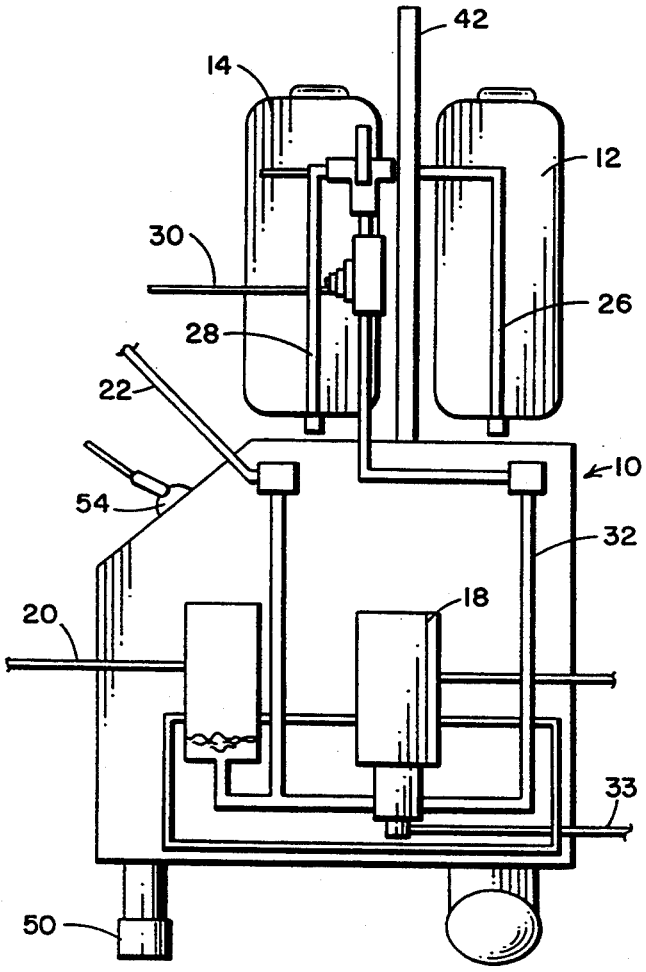
FIG. 2 is a sectioned side view of the spray unit in accordance with the invention.
Figure 3:
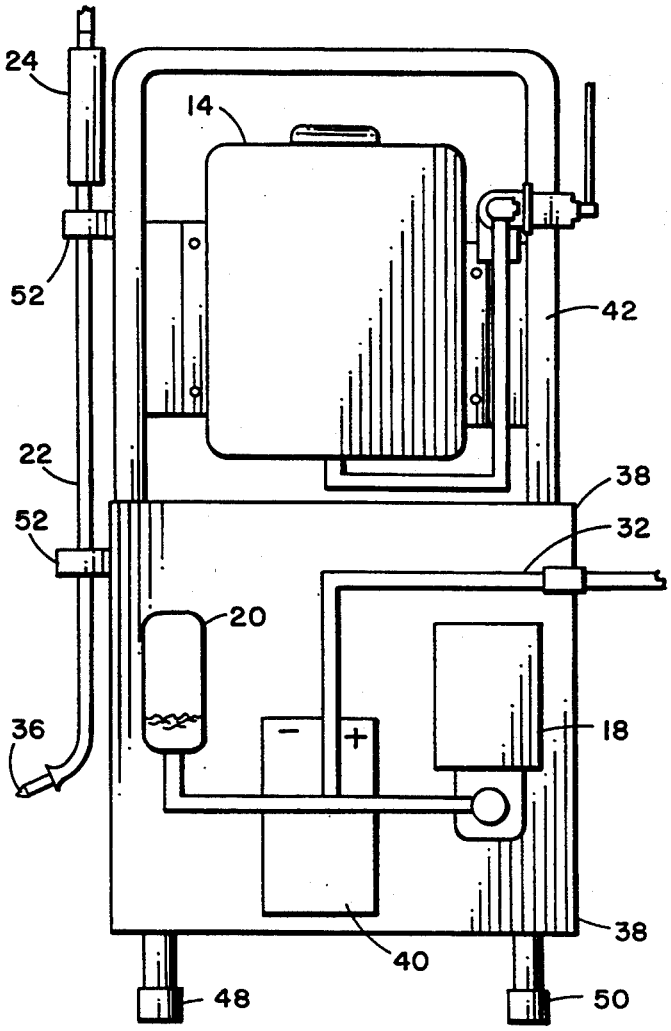
FIG. 3 is a sectioned front view of the spray unit shown in FIG. 2.

Referring to FIGS. 2 and 3, there is shown a sectioned side view of the spray unit 10 having a solution tank 12 and a rinse tank 14 connected through lines, 26 and 28 respectively, to a three way valve 16. Valve 16 selects either line 26 or 28 to allow solution to flow from tank 12 or rinse tank 14. Tanks 12 and 14 are preferably constructed from transparent plastic and hold six quarts of fluid in each.

The output of switching valve 16 is connected through a Y-strainer 30 which filters unwanted particles exiting from tanks 12 and 14. The output of Y-strainer 30 is connected through line 32 to pump 18. Preferably, pump 18 is a 12 DC volt pump and has a pressure sensor 33 which senses the pressure at the output of pump 18. Pump 18 is constructed such that the output is maintained at a constant level of pressure preferably between 50–70 psi. Sensor 33 enables pump when the pressure at the pumps output 18 falls below 50–70 psi.

The output of pump 18 is connected to surge tank 20 and spray wand 22 through line 34. Surge tank 20 maintains a reservoir of fluid, as well as a reservoir of pressure at the output of pump 18.

Spray wand 22 includes a long rod with a distribution end 36 through which fluid is distributed to the device to be sprayed. Spray wand 22 has a trigger 24 which when depressed, permits fluid to flow through wand and out distribution end 36.

Spray unit 10 consists of a lower chassis 38 having a frame and a preferably light metal enclosure with proper supporting accessories to securely hold a surge tank 20, pump 18 and a 12 volt battery 40 to chassis 38. Battery 40 supplies electricity to pump 18 when switched on. Resting on lower chassis 38 is upper chassis 42 which supports solution tanks 12 and 14, as well as three way valve 16.

Mounted to the bottom of lower chassis 38 are wheels 46 and posts 48 and 50. Posts 48 and 50 prevent spray unit 10 from moving. Spray unit is designed to be tilted on its back wheels 46 and thus easily moved. Mounted to the side of upper chassis 42 are clips 52 which holds wand 22 to the side of spray unit 10.

Mounted to the front panel of lower chassis 38 is an off-on switch 54 which allows power to be fed from 12 volt battery 40 to pump 18.

Figure 4:
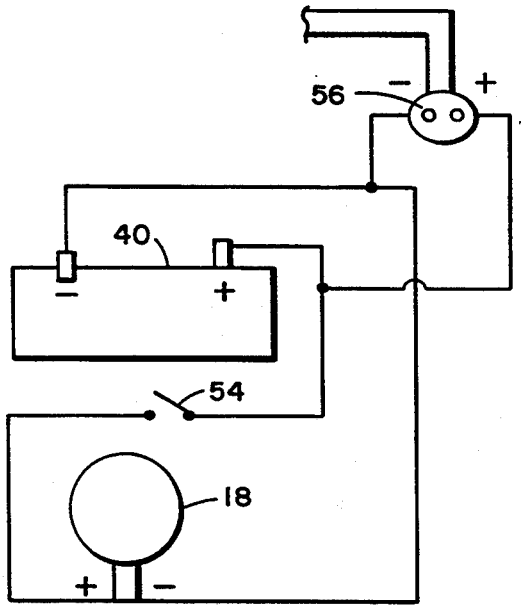
FIG. 4 is a simplified wiring diagram of the spray unit in accordance with the invention.

Referring to FIG. 4, there is shown a wiring diagram of spray unit 10 having pump 18 connected through on-off switch to 12 volt battery 40. Battery 40 is preferably wired through connector 56 to an external battery charger to recharge battery 18 when power has been completely drained therefrom. When on-off switch 54 is turned on, 12 volt pump 18 receives power constantly. However, 12 volt pump 18 is only enabled when the pressure at its output falls below a predetermined level.

It is recognized that the surge tank 20 connected to the output of 12 volt pump 18 maintains a reservoir of fluid, as well as a reservoir of pressure. Thus, tank 20 prevents the 12 volt pump 18 from having to continuously recycle as fluid is distributed to the appliance. It is also recognized that pump 18 does not necessarily turn on when trigger 24 enables spray wand 22. The pump 18 increases the pressure to the surge tank 20 faster than pressure is released from the surge tank 20 when trigger 24 is activated. The pump 18 is only enabled by sensor 32 when its pressure at the output of pump 18 falls below a predetermined level. Thus, the pressure applied to the wand and the surge tank 20 is continuously maintained at a predetermined level without the pump constantly remaining in an on position. Further, current drawn from the battery 18 is reduced when the trigger 24 is activated.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method of spraying fluid held in a container on to devices to be cleaned, the method comprising the steps of:

placing fluid into the container;

pumping with a pump the fluid from the container to a surge tank and through a spray wand onto the devices;

sensing the pressure on an output of the pump, actuating and deactuating the pump to maintain the sensed pump output pressure at about a predetermined level;

dispensing fluid from the wand onto air conditioning coils; and maintaining the pressure dispersed from the wand at a minimum level at which debris on the coils are removed but below the level at which the coils are damaged due to excess fluid pressure.

2. The method as recited in claim 1 further comprising the steps of providing sufficient volume on said surge tank to reduce the time the pump is actuated.

3. The method as recited in claim 1 further comprising the steps of:

enabling said spray wand to dispense fluid;

activating the pump to increase said pump output pressure when said spray wand is activated and the pump output pressure falls below a second predetermined level;

disabling said spray wand from dispersing fluid; and deactivating the pump when said pump output pressure exceeds said set predetermined level and said spray wand has been disabled.

4. The method as recited in claim 1 further comprising the steps of:

providing a second container;

placing fluid on the second container;

selecting the container from which fluid is to be pumped to said wand.

5. The method as recited in claim 1 further comprising the steps of:

dispensing fluid from the wand onto air conditioning coils; and maintaining the pressure dispersed from the wand at a minimum level at which debris on the coils are removed but below the level at which the coils are damaged due to excess fluid pressure.

* * * * *